US010077150B2

(12) United States Patent
Laidler et al.

(10) Patent No.: US 10,077,150 B2
(45) Date of Patent: Sep. 18, 2018

(54) DISPENSER WITH A RESERVOIR COMPRISING A DIVIDER OR A POROUS MATERIAL

(71) Applicant: PLASTIPAK BAWT S.a.r.l., Bascharage (LU)

(72) Inventors: Keith Laidler, West Midlands (GB); Timothy Rodd, Hants (GB)

(73) Assignee: Plastipak BAWT S.a r.l., Bascharage (LU)

( * ) Notice: Subject to any disclaimer, the term of this patent is extended or adjusted under 35 U.S.C. 154(b) by 0 days.

(21) Appl. No.: 14/903,345

(22) PCT Filed: Jul. 8, 2014

(86) PCT No.: PCT/GB2014/000272
§ 371 (c)(1),
(2) Date: Jan. 7, 2016

(87) PCT Pub. No.: WO2015/004410
PCT Pub. Date: Jan. 15, 2015

(65) Prior Publication Data

US 2016/0145034 A1 May 26, 2016

(30) Foreign Application Priority Data

Jul. 10, 2013 (GB) ..... 1312362.5
Aug. 6, 2013 (GB) ..... 1314023.1
(Continued)

(51) Int. Cl.
*B65D 83/60* (2006.01)
*B05B 15/30* (2018.01)
(Continued)

(52) U.S. Cl.
CPC ..... *B65D 83/60* (2013.01); *B05B 11/0059* (2013.01); *B05B 15/30* (2018.02);
(Continued)

(58) Field of Classification Search
CPC ..... B65D 83/60; B65D 83/44; B65D 83/754; B65D 83/32; B65D 83/36; B65D 83/646;
(Continued)

(56) References Cited

U.S. PATENT DOCUMENTS 489,786 A * 1/1893 Bonbrake ..... B65D 83/38 222/394
4,148,419 A * 4/1979 MacNair ..... B65D 83/425 141/20
(Continued)

FOREIGN PATENT DOCUMENTS

AT 307305 B 5/1973
GB 1184065 A * 3/1970 ..... B05B 11/0059
(Continued)

OTHER PUBLICATIONS

European Patent Office; International Search Report and Written Opinion issued in corresponding International Application No. PCT/GB2014/000272. dated Dec. 12, 2014.

*Primary Examiner* — Donnell Long
(74) *Attorney, Agent, or Firm* — Fishman Stewart PLLC

(57) ABSTRACT

A pressurized dispenser includes a base and a peripheral wall having an open end sealed by a dispensing element comprising a dip-tube, a fluid reservoir in contact with the dip-tube for reducing the compressed gas lost from the pressurized dispenser, a compressed gas and a dispensing liquid. In embodiments, a majority of the fluid reservoir may be located outside of the dip-tube, and the fluid reservoir may include a porous material, arranged in use to hold a volume of the dispensing liquid. Such porous material may
(Continued)

be configured so that, in use, at least a portion of any compressed gas in the reservoir can be displaced by the liquid, ejecting such portion of the compressed gas into the dispenser. In embodiments, the dispensing element may be configured to dispense dispensing liquid continuously for at least 0.5 seconds, upon actuation of the dispensing element.

21 Claims, 6 Drawing Sheets

(30) Foreign Application Priority Data

| | | |
|---|---|---|
| Feb. 12, 2014 | (GB) | 1402413.7 |
| Apr. 17, 2014 | (GB) | 1406951.2 |
| Jun. 2, 2014 | (GB) | 1409751.3 |

(51) Int. Cl.

| | |
|---|---|
| ***B65D 83/32*** | (2006.01) |
| ***B65D 83/36*** | (2006.01) |
| ***B65B 31/00*** | (2006.01) |
| ***B65D 83/44*** | (2006.01) |
| ***B65D 83/14*** | (2006.01) |
| *B05B 11/00* | (2006.01) |
| *B65D 83/42* | (2006.01) |
| *B65D 83/64* | (2006.01) |

(52) U.S. Cl.
CPC ..... *B65B 31/003* (2013.01); *B65D 83/32* (2013.01); *B65D 83/36* (2013.01); *B65D 83/44* (2013.01); *B65D 83/754* (2013.01); *B05B 11/0048* (2013.01); *B05B 11/0051* (2013.01); *B65D 83/42* (2013.01); *B65D 83/425* (2013.01); *B65D 83/64* (2013.01); *B65D 83/646* (2013.01)

(58) Field of Classification Search
CPC ..... B65D 83/42; B65D 83/425; B65D 83/64; B05B 15/005; B05B 11/0059; B05B 11/0048; B05B 11/0051; B65B 31/003
USPC ..... 222/464.1, 464.2, 321.1, 321.6–321.9, 222/383.1, 383.3, 402.1
See application file for complete search history.

(56) References Cited

U.S. PATENT DOCUMENTS

| | | | | |
|---|---|---|---|---|
| 6,250,508 | B1 | 6/2001 | Geser et al. | |
| 2003/0150885 | A1* | 8/2003 | Dunne | B65D 83/62 222/402.24 |
| 2010/0199983 | A1* | 8/2010 | Jinks | A61M 15/009 128/200.23 |

FOREIGN PATENT DOCUMENTS

| | | | |
|---|---|---|---|
| GB | 2356674 | A | 5/2001 |
| JP | 2007-319729 | | 12/2007 |
| WO | 2005/032728 | A2 | 4/2005 |
| WO | 2009/090578 | A1 | 7/2009 |

* cited by examiner

DISPENSER WITH A RESERVOIR COMPRISING A DIVIDER OR A POROUS MATERIAL

CROSS-REFERENCE TO RELATED APPLICATION

This application is a national stage filing based upon International PCT Application No. PCT/GB2014/000272, with an international filing date of Jul. 8, 2014, which claims the benefit of priority to Great Britain patent application Nos. GB1312362.5, filed Jul. 10, 2013; GB1314023.1, filed Aug. 6, 2013; GB1402413.7, filed Feb. 12, 2014; GB1406951.2, filed Apr. 17, 2014; and GB1409751.3, filed Jun. 2, 2014, all of which are fully incorporated herein by reference as though fully set forth herein.

TECHNICAL FIELD

This invention relates to dispensers having dividers or fluid reservoirs therein arranged to at least partially prevent gas or air in the dispensers from being ejected through dip tubes in the dispenser. The invention further relates to dividers for use in fluid dispensers, which dividers at least partially prevent mixing of gas/air and fluid in a dispenser, in use.

BACKGROUND

It is known to provide both pressurized fluid dispensers, and non-pressurized fluid dispensers which dispense fluid through a nozzle arrangement, and which may include a dip tube connected to the nozzle arrangement, through which fluid is dispensed.

Nozzle arrangements are commonly used to facilitate the dispensing of various fluids from containers or vessels. For instance, nozzle arrangements are commonly fitted to pressurized fluid filled vessels or containers, such as an aerosol canister, to provide a means by which fluid stored in the vessel or container can be dispensed. In addition, so called pump and trigger activated nozzle arrangements are also commonly used to enable the fluid contents of a non pressurized vessel or container to be conveniently dispensed in response to the operation of the pump or trigger by an operator. Another version that is much less commonly used uses a pump or trigger to pressurize the air and fluid inside the container and this pressure can be topped up as the fluid is used up. This effectively becomes the same as an aerosol canister in use.

A typical nozzle arrangement comprises an inlet through which fluid accesses the nozzle arrangement, an outlet through which the fluid is dispensed into the external environment, and an internal flow passageway through which fluid can flow from the inlet to the outlet. In addition, conventional nozzle arrangements comprise an actuator means, such as, for example, a manually operated pump or trigger or aerosol canister. The operation of the actuator means causes fluid to flow from the container to which the arrangement is attached into the inlet of the arrangement, where it flows along the fluid flow passageway to the outlet.

Many liquors, foams or pastes are delivered using manually operated aerosol cans, pumps or triggers and they often have a diptube reaching from the top or outlet of the container to the bottom so that the fluid is drawn from the bottom to the top and out through the outlet. Sometimes these diptubes are part of the container and can be in the centre of the container or along a wall of the container especially with plastic containers. A large number of commercial products can be dispensed this way, including, for example, tooth paste, antiperspirants, de-odorants, perfumes, air fresheners, antiseptics, paints, insecticides, polish, hair care products, pharmaceuticals, shaving gels and foams, water and lubricants.

Most fluids are simply held in the container with air taking up the remainder of the container with pumps or triggers and air or a propellant taking up the remainder of the container for aerosols or pressurized containers. This is no problem for most fluids but some need to be kept separate from the air or in the case of aerosol canisters from the pressurized propellant which may be air or butane or other alternatives like CO2. Some products like foods can go off and others like shaving gel can expand and become either unusable or unstable. This also prevents accidental loss of the air or propellant when the device is used and this can be a problem.

The problem of separating the fluid from the air or propellant has been generally approached in two different ways. In aerosol cans deformable bags are used in can or via bags attached to valves. The fluid is kept in a bag inside the canister and the bag is either sealed around part of the can itself or around the valve in the can and the propellant gas is inside the can and around the bag. When the outlet valve is opened by depressing the actuator, the gas pressure acting on the bag forces out the fluid through the valve and actuator and the bag is compressed. The bags are often made of up to 4 different layers of material so as to keep the propellant and fluid apart and they are relatively expensive and the assembly process is generally expensive and complicated. The bags often never completely empty the contents and 5-10% of the fluid tends to remain in the bag.

With pumps and triggers bags are also sometimes used and another approach has been to use a shaped plate between the fluid and air called "follower plates" as they follow the fluid as the container empties. These plates seal against the side walls of the container and are upstream of the fluid in the container usually towards the base. As the fluid is discharged, the plate moves downstream keeping the fluid chamber filled. For this to work the walls of the container have to be parallel and the vessel is usually tubular or oval in shape. The plate is usually shaped to match the shape of the downstream end or top of the container so as to be able to drive most or substantially all of the fluid out of the container. If the top of the container is shaped like a standard bottle or container with a reduced neck on the shoulder then the bottom of the chamber has to be open so the follower plate can be inserted through the bottom. Alternatively, with a closed bottom the top of the container has to be the same size and shape as the rest of the container so the follower plate can be inserted from the top.

Advantages of follower plates include that they are relatively cheaper to make and assemble than other means described hereinabove. One disadvantage is that they cannot be used with diptubes or inside aerosol cans or with bottles or containers with smaller necks and a closed base.

Bags are widely used in pump or trigger containers and they can be a separate bag that is inserted after the container is made or they can be moulded into the container. The fluid is put inside the bag and is delivered by being sucked out of the bag by the pump or trigger collapsing the bag. Air is drawn into the container through a hole or aperture in the container wall or top and then around the bag as the bag is collapsed and the air is at atmospheric pressure. Sometimes the bag is made of one plastic or rubber and other times it is made of layers of different materials depending upon the barrier properties required to protect the fluid. These systems are generally more expensive than follower plates although they may be more versatile and standard containers can be used. Bags tend to be made of layers because they are thin whereas a follower plate tends to be thicker and made of a stronger, more chemically resistant plastic creating robust barrier.

There are two general types of aerosol cans with one having a seam along the length of the can and a separate top and bottom joined to the body and the other being seamless and made from one part which is drawn into shape and a separate top joined to the body. Known follower plates would not work with seamed containers as there would be no seal because of the seam. In seamless cans with reduced neck diameters it is not possible to use a follower plate because of the reduced neck preventing insertion of the plate and another problem with aerosol cans comprising diptubes is that any diptube present would be in the way of the follower plate.

It is therefore an aim of embodiments of the invention to provide fluid dispensers which enable separation of at least some of the air/gas or propellant in a dispenser from the dispensing liquid and which prevent or reduce leakage of the air/gas or propellant into a diptube or out of the dispenser. It is also an aim of embodiments of the invention to provide divider or fluid reservoirs for us in fluid dispensers which can be used in a wide variety of dispensers and which are robust, relatively inexpensive to make an insert, and which can be inserted into a wide variety of fluid dispensers including seamed dispensers, dispensers with reduced diameter necks and aerosols or other pressurized containers.

It is also an aim of embodiments of the invention to overcome or mitigate at least one problem of the prior art described herein above.

SUMMARY

According to a first aspect of the invention there is provided a pressurized dispenser comprising a base around which surrounds a peripheral wall having an open end sealed by a dispensing element comprising a dip-tube, a fluid reservoir in contact with the dip-tube for reducing the compressed gas lost from the pressurized dispenser, a compressed gas and a dispensing liquid, wherein a majority of said fluid reservoir being located outside of the diptube and the fluid reservoir comprises a porous material, arranged in use to hold a volume of the dispensing liquid, the porous material being configured so that in use at least a portion of any compressed gas in the reservoir can be displaced by the liquid, ejecting said portion of the compressed gas into the dispenser, and wherein the dispensing element is configured to dispense the dispensing liquid continuously for at least 0.5 seconds, upon actuation of the dispensing element.

According to a second aspect of the invention there is provided a pressurized dispenser comprising a base around which surrounds a peripheral wall having an open end sealed by a dispensing element comprising a dip-tube or an outlet, a fluid reservoir in contact with the dip-tube or outlet for reducing the compressed gas lost from the pressurized dispenser, a compressed gas and a dispensing liquid, wherein the fluid reservoir comprises a porous material, arranged in use to hold a volume of the dispensing liquid, and wherein the porous material is configured so that in use at least a portion of any compressed gas in the reservoir can be displaced by the liquid, ejecting said portion of the compressed gas into the dispenser.

According to a third aspect of the invention there is provided a method of forming a pressurized dispenser of the first or second aspects of the invention, the method comprising the steps of:

a. Providing a dispenser comprising a base around which surrounds a peripheral wall having an open end; and in any order or together
b. Inserting a porous fluid reservoir as claimed in any one of claims 1 to 33 into the dispenser;
c. Inserting a dip-tube having a fluid inlet end into the open end of the dispenser; and
d. Adding a dispensing liquid and compressed gas to the dispenser.

According to a fourth aspect of the invention there is a fluid dispenser comprising a base around which surrounds a peripheral wall having an open end closed by a dispensing element comprising a dip-tube, the fluid dispenser comprising a divider.

According to a fifth aspect of the invention there is provided pressurized dispenser comprising a base around which surrounds a peripheral wall having an open end sealed by a dispensing element comprising a dip-tube, a fluid reservoir in contact with the dip-tube for reducing the compressed gas lost from the pressurized dispenser, a compressed gas and a dispensing liquid, wherein the fluid reservoir comprises a porous material, arranged in use to hold a volume of the dispensing liquid, the porous material comprising a porous or cellular material having a pore or cell density of at least 10 ppi (pores/cells per inch), at least 20 ppi or at least 30 ppi, and no more than 100 ppi or no more than 80 ppi.

According to a sixth aspect of the invention there is a method of forming a dispenser of any one of the first, second, fourth or fifth aspects of the invention, the method comprising the steps of:

e. Providing a fluid dispenser comprising a base around which surrounds a peripheral wall having an open end; and in any order or together
f. Inserting a porous divider of any one of claims into the dispenser; and
g. Inserting a dip-tube having a fluid inlet end into the open end of the dispenser;

According to a seventh aspect of the invention there is a method of dispensing a fluid from a fluid dispenser of the sixth aspect of the invention comprising forming a dispenser, partially filling the dispenser with a dispensing liquid such that at least some of the liquid enters the porous divider material, partially filling the dispenser with a gas, or air, and actuating the dispensing element to dispense at least a portion of the dispensing liquid.

According to a eighth aspect of the invention there is a divider for at least partially separating a dispensing fluid from a propellant, gas or air in a dispenser, the divider comprising a resiliently deformable member arranged to be inserted into a dispenser through one end thereof and move from a first configuration, in which the divider can be inserted into a dispenser, and a second configuration in which the divider is able to form at least a partial barrier within the dispenser.

According to a ninth aspect of the invention there is a method of separating a fluid dispenser into two chambers, the method comprising the steps of:

a. Providing a fluid dispenser comprising a base around which surrounds a peripheral wall having an open end;
b. Providing a divider of the eighth aspect of the invention;

c. Moving the divider from the second configuration to the first configuration;
d. Inserting the divider into the fluid dispenser; and
e. Moving the divider to the second configuration to form at least a partial barrier separating the dispenser into two chambers.

According to a tenth aspect of the invention there is a fluid dispenser comprising a base around which surrounds a peripheral wall having an open end, and further comprising a divider of the eighth aspect of the invention, the divider forming two chambers within the dispenser and being movable up and down the dispenser wall to vary the size of the chambers, in use.

According to an eleventh aspect of the invention there is a method of dispensing a fluid from a fluid dispenser of the tenth aspect of the invention comprising:

a. at least partially filling one of the chambers with a dispensing fluid;
b. filling the other chamber with a pressurized gas or air;
c. operably connecting the dispensing fluid with a dispensing element; and
d. actuating the dispensing element to dispense the dispensing fluid and move the divider within the dispenser.

Further aspects of the invention, and features of the various aspects of the invention are defined in the appended claims.

The eighth to eleventh aspects of the invention provide resiliently deformable divider or follower plate that will be deformed to enable it to fit through a reduced neck and reform to function as a standard follower. In some embodiments, the dividers may have an aperture substantially in the centre that the diptube extends through in such a way that there is at least one seal between the diptube and divider and this seal is usually an integral part of the divider. In both cases there may be a seal around the outside of the divider that seals between the divider and the dispenser, and this seal is usually an integral part of the divider. The inner and outer seal may both be air tight but loose enough to enable the divider to move up and down the can as required. The divider may be resiliently deformable only in certain parts of it or it may all be resiliently deformable. The divider may be made from a polymeric or natural or synthetic rubber and may be one component and made of one material but two or more materials or two or more parts of one or more materials may be used if certain barrier properties are required or part of the divider could be coated in some way to enhance the barrier properties. For example it may be painted, coated or even coated or plated with metal on one or more sides.

The divider may be a follower plate.

Two chambers may be created inside the dispenser with one upstream of the divider and the other downstream of it. The air or compressed gas is normally upstream of the divider and the fluid downstream of the divider. If no diptube is used then the downstream chamber may use the outlet as a wall and if a diptube is used the non-outlet end or the base may used as a wall. With no diptube the divider may moves towards the outlet end or the top of the dispenser and with a diptube the divider moves towards the closed end or the base. The divider may be shaped so that it is substantially the same shape as the end of the dispenser that it moves towards so that all or substantially all of the fluid may be emptied.

In some embodiments, suitable for fluid dispensers in the form of aerosols the divider may be positioned on the downstream or closed end of the dispenser (usually the base), the diptube extends through the central hole in the divider and the or each seal may touch the downstream end of the dispenser. The upstream end of the diptube may be shaped so there is a gap around the end of the diptube so the fluid may flow through it. There may be a top on the dispenser which, in the case of an aerosol, may be located on a valve in a valve cup, and the diptube may be connected to the valve inlet. Any air between the downstream wall and the divider may be substantially sucked out. Fluid may be pumped through the diptube via the valve which is lifted to open it, into the downstream chamber and the divider may be pushed upstream by the fluid and may continue to move until all of the required fluid had been added to the chamber. The diptube may not move and the downstream end of the diptube may then be closed by releasing the valve so the valve automatically closes.

Air in the upstream chamber may be allowed to evacuate around the valve cup which would only be fixed in place but not sealed as the downstream chamber is filled with fluid and the divider moved upstream. Once the fluid chamber is filled there may be half to two thirds of the dispenser containing air and the fluid chamber may be used for the pressurized air or propellant or gas. If the dispenser contains air, pressurized air may be added to the gas chamber by pumping pressurized air under the valve cup and once the required pressure is achieved the valve may be crimped in place sealing it. If a propellant such as butane is used instead of air, any remaining air in the upstream chamber may be removed and then replaced with the required propellant subsequently followed be sealing the valve cup by crimping as before.

As the fluid is dispensed, the divider may move downstream towards the base keeping in contact with the fluid, and the valve of gas chamber increases causing a reduction in pressure of the gas. This process may continue until substantially all of the fluid has been ejected but there may still be air or gas in the gas chamber and the pressure of it will depend on the pressure required to eject the fluid. It may normally be between 1 and 3 bars. The action would be the same with a propellant such as butane for example, while other propellants may maintain a more consistent pressure throughout the working life of the dispenser.

In alternative embodiments of fluid dispensers of the invention, which comprise aerosol canisters the fluid may be in the chamber with the outlet wall or valve (now the downstream chamber) and the air or propellant in the chamber with the base (now the upstream chamber). With a closed wall or base the divider may start at the outlet end of the dispenser and there may be no diptube. Any residual air may be sucked out of the downstream chamber and then the fluid may be added into the downstream chamber through the valve which pushes the divider upstream towards the base wall of the dispenser leaving around half to one third of the dispenser inner volume for the propellant of compressed gas or air. There may be a hole in the upstream container wall or base and a one way input valve to allow the air or propellant to be pumped into the upstream chamber. As the fluid is dispensed, the divider may move downstream and the pressure in the upstream chamber may reduce. One advantage of this embodiment is that there is no diptube.

In embodiments comprising a pump or trigger the fluid would normally be put in the upper chamber with the outlet or downstream chamber with the air in the lower chamber with the base or the upstream chamber. The divider may start at the downstream end of the dispenser and there may be no diptube. Any residual air may be sucked out of the downstream chamber and then the fluid may be added into the downstream chamber to push the divider upstream usually towards the upstream wall of the dispenser. There may be a hole in the upstream container wall to allow the air or gas to escape so the remaining air is always at atmospheric pressure. As the fluid is dispensed, the divider may move downstream and air may be drawn into the air chamber through the same hole in the chamber wall to maintain atmospheric pressure.

For embodiments comprising a pump or trigger device, the open end of the dispenser top may be closed with the pump or trigger. As the fluid is dispensed a vacuum may be created in the fluid chamber causing the divider to move downstream so the fluid chamber stays full of fluid. This creates negative pressure in the air chamber so air may enter from outside the dispenser to keep it at atmospheric pressure. This action may continue until the divider meets the upstream wall having evacuated substantially all of the fluid.

In embodiments comprising a pump or trigger, the fluid may be put in the chamber with the base or closed wall (now the downstream chamber) and the air in the chamber with the opening (now the upstream chamber). The divider may start at the downstream or base end of the container and there may be a diptube. Initially any residual air may be drawn out of the downstream chamber and then the fluid added into the downstream chamber through the diptube and which pushes the divider upstream towards the upstream wall of the container or open end. There may be a hole or aperture in the upstream dispenser wall or the top to allow the air to escape so the remaining air or gas is always at substantially atmospheric pressure. As the fluid is dispensed, the divider may follow the fluid and air is pulled into the air chamber through the same hole in the chamber wall to maintain substantially atmospheric pressure.

Suitable material for the divider may be plastics, such as polyethylene or polypropylene for example, as these are very resistant to many fluids and propellants.

One way of achieving a deformable divider is to use areas or lines of weakness such as very thin sections, such as annular "V" shaped grooves which enables relatively easy deformation. Another way would be to use a mixture of porous foaming agent such as a closed cell material in the divider in combination with a relatively rigid material like polyethylene or polypropylene so it is both resiliently deformable and chemically resistant. An alternative would be to use two materials with the first material having a weakness in the area needed to deform and either over moulding or attaching a more resiliently deformable material such as a flexible version of the first material or an elastomer, in this way the chemical barrier may be maintained whilst the mechanical properties are added with the second material.

In embodiments comprising diptubes in the dispenser may be made from a rigid plastic material, or from a hard flexible plastics material. Some dispensers may have an integral diptube in the body of the dispenser and these could be used instead of the diptube in the follower plate.

One problem with known aerosol canisters particularly with compressed air and with pumps or triggers is inability to use such aerosols through 360 degrees where rotation of the canisters may cause the upstream end of a diptube can sometimes be in contact with the air or propellant instead of the fluid. For aerosols, this can be a major problem as the gas or air can be lost very quickly resulting in fluid being left in the canister or very low pressures near the end of the can life and a consequent reduction in performance. The dividers and dispensers of the invention described above overcome or mitigate this problem. In the embodiments there may be no need to keep the fluid separate from the air or propellant but instead is to keep the upstream end of the diptube always immersed in the fluid regardless of how the dispenser is shaken, tilted or inverted. Some gas or air can be lost but should be minimized. The divider and diptube arrangement described above can be used in these applications. It is not essential that any seals are always maintained as the divider may act as barrier that prevents or reduces a rapid movement of the fluid away from the upstream end of the diptube when the dispenser is tilted or shaken and it may be configured so that one or both seals are able to leak because once the dispenser is left upright the air or propellant and fluid will tend to return to the uppermost chamber and the fluid to the lower chamber especially in dispensers where the propellant is pressurized. There may be small holes in the divider to allow the fluid to return to the downstream chamber. Any gaps in the seal or holes in the divider should be small enough to ensure that the divider is pushed towards the fluid by the gas or propellant. This means that the divider may be relatively thin like packaging used in the food industry or it could be a closed cell foamed divider or even an open cell foam divider with an impermeable layer or skin on the surface that prevents any fluid passing through the divider.

The divider may not need to move, and thus the divider may be immovable within the dispenser. It may be fixed in position, preferably near to the downstream end of the dispenser with a small chamber formed between the divider and base of the dispenser. A diptube may pass through the divider and into the chamber which would contain the fluid to be dispensed. Fluid would be able to pass through or around the divider to replace any fluid dispensed. The rate that the fluid could enter the chamber would be comparable but greater than the flow at which it is dispensed as there is always fluid available to be dispensed. If the dispenser is tilted or shaken the loss of the fluid from the chamber may be reduced and the amount of air or gas that replaces it is also reduced. Any air or gas in the small chamber lost whilst the fluid was being dispensed is substantially reduced compared to the loss with no divider. In addition, once the dispenser is left upright, any air or gas would move upwards past or through the divider and would be replaced by the fluid.

In some embodiments the divider is made of a porous material such as foam and the upstream end of the diptube is located inside the foam. The fluid can now pass around the divider but would normally pass through it as it is either drawn or pushed into and through it. There may be no need to seal the divider against the dispenser walls or even the need to create a chamber between the divider and the base of the dispenser as the porous material may hold enough of the fluid itself. In some embodiments the dispenser may have one or more shaped bases or a peak in the base, and comprise a substantially flat porous divider which contacts the or each peak such that at least one chamber is formed in each recess extending from the peak. Fluid may be drawn through the diptube from inside of the porous divider and this causes more fluid to replace it. If the dispenser is upright then more fluid from above porous divider will be absorbed into it and the chamber below the divider may be full of fluid and any air or propellant may go around or through the divider into the chamber above it. If the dispenser is inverted then fluid will still go from the divider through the diptube and outlet and the fluid inside the small chamber now above the divider may be absorbed into the foam with air or propellant replacing it by going through or around the divider. When the container is angled somewhere between the two extremes of upright and inverted, the fluid will be touching at least some of the divider and will be absorbed. This may continue until the small chamber is empty and the fluid has been extracted from the divider but the dispensers tend to be moved through many angles as they are used so the fluid can quickly replenish the small chamber. The reservoir of fluid in the chamber and divider is generally more than enough for the likely usage at any one time which means there is generally no need to lose much, if any, air or propellant. There is also no need to have a smaller chamber for many applications and the foam divider may be made large enough to hold a sufficient volume of fluid. The divider may touch the base or walls of the dispenser and may be held around the diptube or may be any shape with the diptube pushed inside it. Generally it may be positioned on or around the upstream end of the diptube and touching the downstream wall and base of the dispenser. These embodiments are generally for small dispensers used with products like perfume as the foam divider can be very small such as a plug or rod on the end of the diptube for example. For large dispensers a divider in the form of a plug or rod is also useful. In some embodiments an open cell rod such as a backer rod, used in sealing applications, may be used.

A porous plug or rod is one solution to a problem because the foam is relatively cheap; it is easily pushed through a reduced neck in a dispenser and if it is larger than the neck, it readily reforms. It can be made from many materials including plastics, synthetic or natural rubber, paper or any other materials that will form a stable porous material and the porous material can even be made inside the dispenser by spraying or mixing materials inside the dispenser. Fluid and gas or propellants are able to rapidly flow into it yet may retain most of that fluid as the dispenser is moved around or shaken. The porous material naturally absorbs liquid in preference to gas or air and may replace gases with liquid so there may be very little gas or air lost in practice. Some closed cell foams can be converted into open cell foams by making holes in the material or the outer layer and these materials may also be used.

Any suitable absorbent or porous material may be used instead of the open cell foam described above provided the absorbent material is stable in the dispenser and fluid environment and that the fluid flows readily through it. Any material that has the required properties will suffice. Various foam and absorbents may be combined together for some applications.

Some foams or absorbents are designed to only allow liquids through and to prevent gas or air and these may also be connected to the end of the diptube or around the outlet.

BRIEF DESCRIPTION OF THE DRAWINGS

Further aspects and features of the invention will be understood from the following description of a number of embodiments of the invention, which are provided by way of example only, with reference to the accompanying drawings, in which.

DETAILED DESCRIPTION

Figure 1:
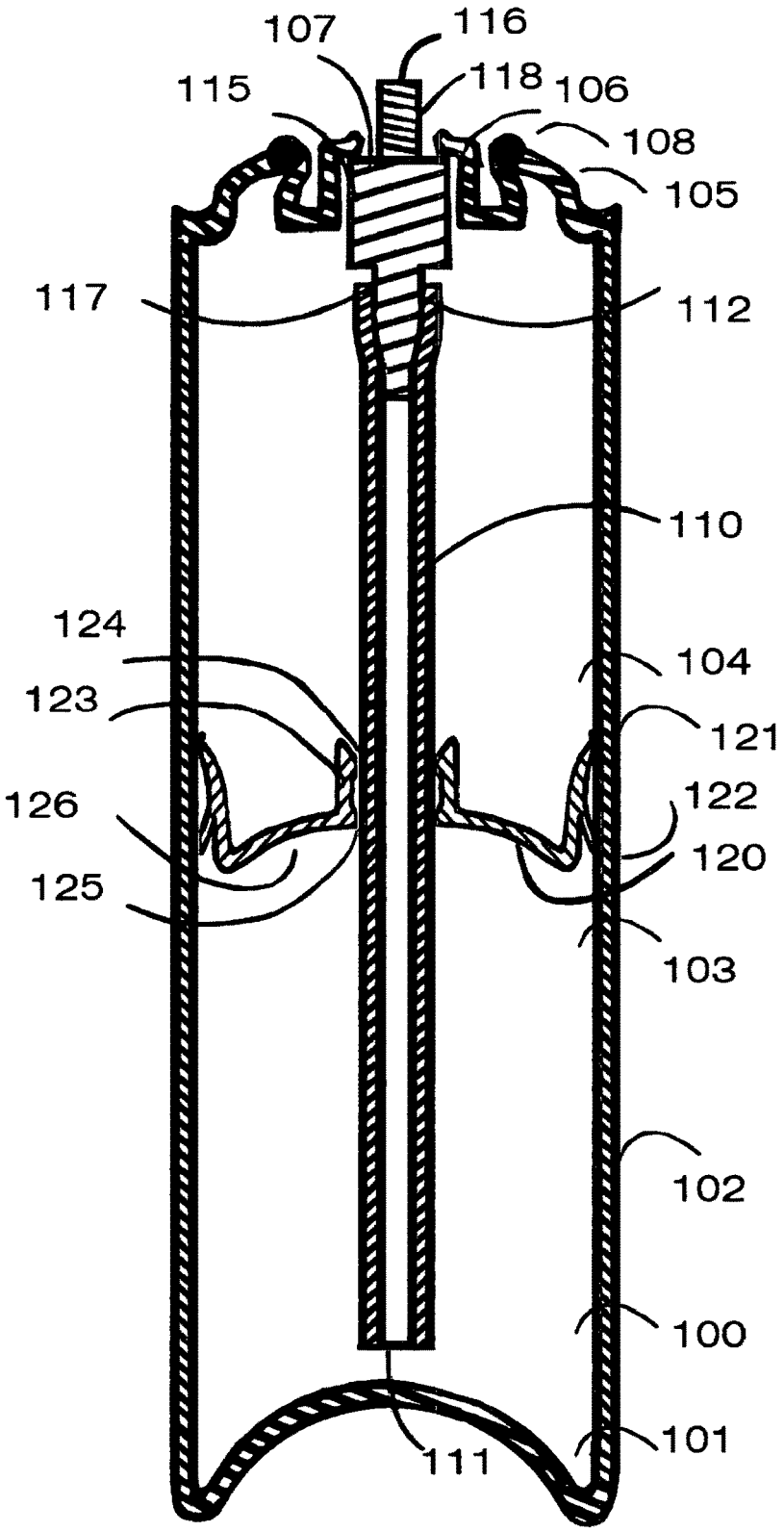
FIG. 1 is a cross-sectional view though a dispenser of the invention in the form of an aerosol canister with divider of the invention inside and a diptube.
Figure 2:
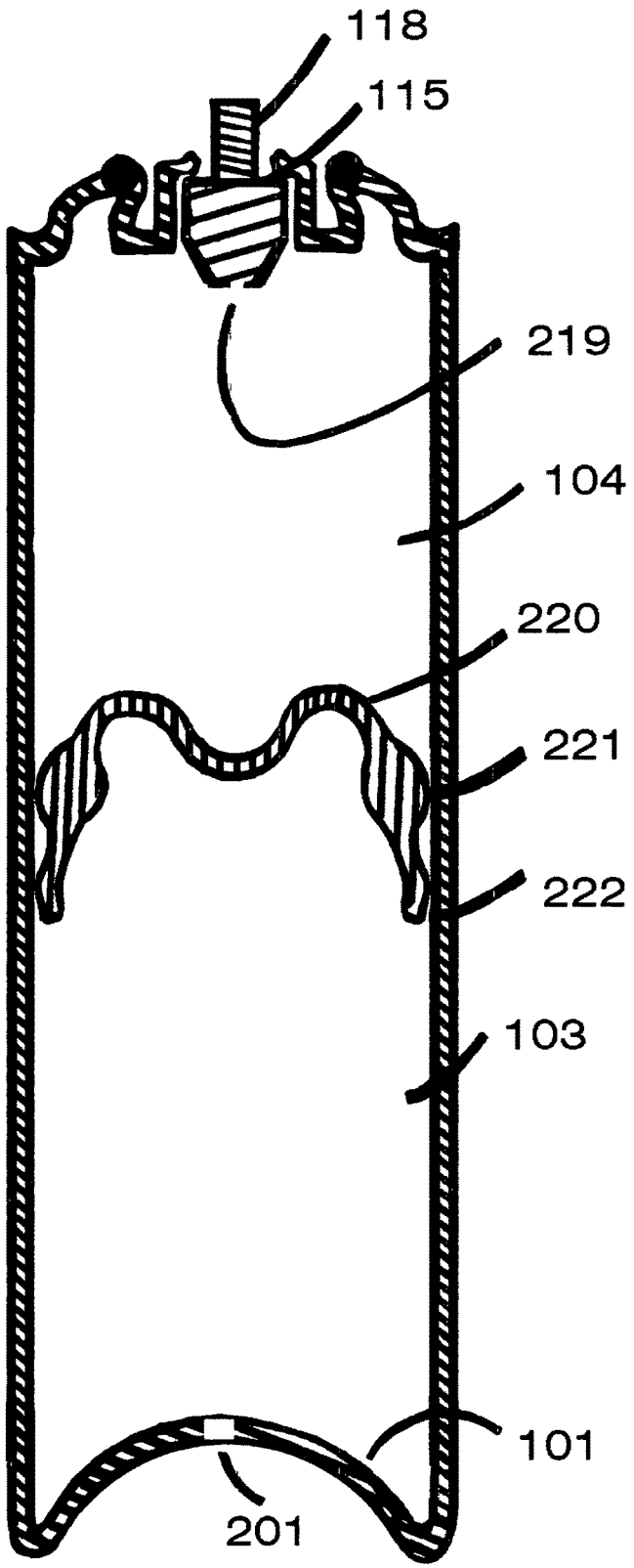
FIG. 2 is a view similar to that of FIG. 1 but showing the version with no diptube.

FIGS. 1 and 2 show a pressurized dispenser of the invention in the form of a pressurized aerosol canister 100 with a divider of the invention in the form of a shaped dividing or follower plate 120 and diptube 110 in accordance with the invention. The downstream chamber 103 would contain the fluid to be dispensed and the downstream wall 101 is the base of the canister which has a wall 102 and reduced opening or neck 105. The upstream chamber wall comprises the neck 105 of the canister and the valve cup 106. A valve 115 is inserted and sealed in the opening 107 and a valve cup 106 is crimped and sealed around the neck 105 at 108. The diptube 110 is fixed onto the valve 115 onto a neck portion 117 at the downstream end and passes through a hole 123 in the dividing plate and almost contacts the base 101 at the upstream end 111. The propellant or air is contained in the upstream chamber 104. The dividing plate 120 has two outer annular seals 121 and 122 that seal against the canister wall 102 and two inner annular seals 124 and 125 that seal against the diptube 110. The fluid to be delivered is filled through the valve outlet 116 by lifting up a valve stem 118 to open the valve internally and pumping the fluid through it and the diptube into a lower chamber 103. The valve stem is then released closing off the valve and sealing in the fluid. The aerosol valves are all standard and the workings are not shown here. A divider in the form of dividing plate 120 is put inside the can through the neck 105 of the canister and has to be deformed to get it inside and then it has to resiliently reform once inside. Sometimes the diptube 110 is inside the divider plate 120 before it is deformed and other times it is put through afterwards. The dividing plate 120 would normally start touching the base 101 and its base 126 is shaped to conform to the base 101 of the canister 100 and it would slide up the diptube 110 and canister wall 102 as the chamber 103 is filled. Normally chamber 103 would then be 50-75% of the canister capacity.

The propellant or air would then be pumped under pressure into an upper chamber 104 formed between the neck 105 of the canister and the dividing plate 120. Once filled the valve cup 106 and canister neck 105 would be crimped together at 108 forming a permanent seal. The contents of the two chambers cannot mix because of the seals 124, 125, 122 and 121 around the dividing plate 120.

As the fluid is dispensed through an outlet 116 in the valve 115 by depressing an actuator on the valve stem 118 the dividing plate moves downstream staying substantially in contact with the fluid. This increases the size of the upstream chamber 104. Eventually the divider plate 120 contacts the base 101 and by then virtually all of the fluid in chamber 103 has been evacuated.

The propellant in chamber 104 will often be air or gas and consequently the pressure in the chamber will reduce as the fluid is dispensed. Sometimes it will be a voc like butane and will exist in liquid and gas and will maintain a similar pressure as the fluid is expelled by more liquid turning into gas.

The dividing plate 120 is normally a solid and relatively thin plate but it could be made in a wide range of materials as required and it could for example, be a closed cell foam plate which would give it the flexibility to the deformed and pushed through the reduced opening. Some products made of open cell foam have an impermeable layer or skin around the outside or are coated so nothing will pass through and these could also be used.

Figure 3:
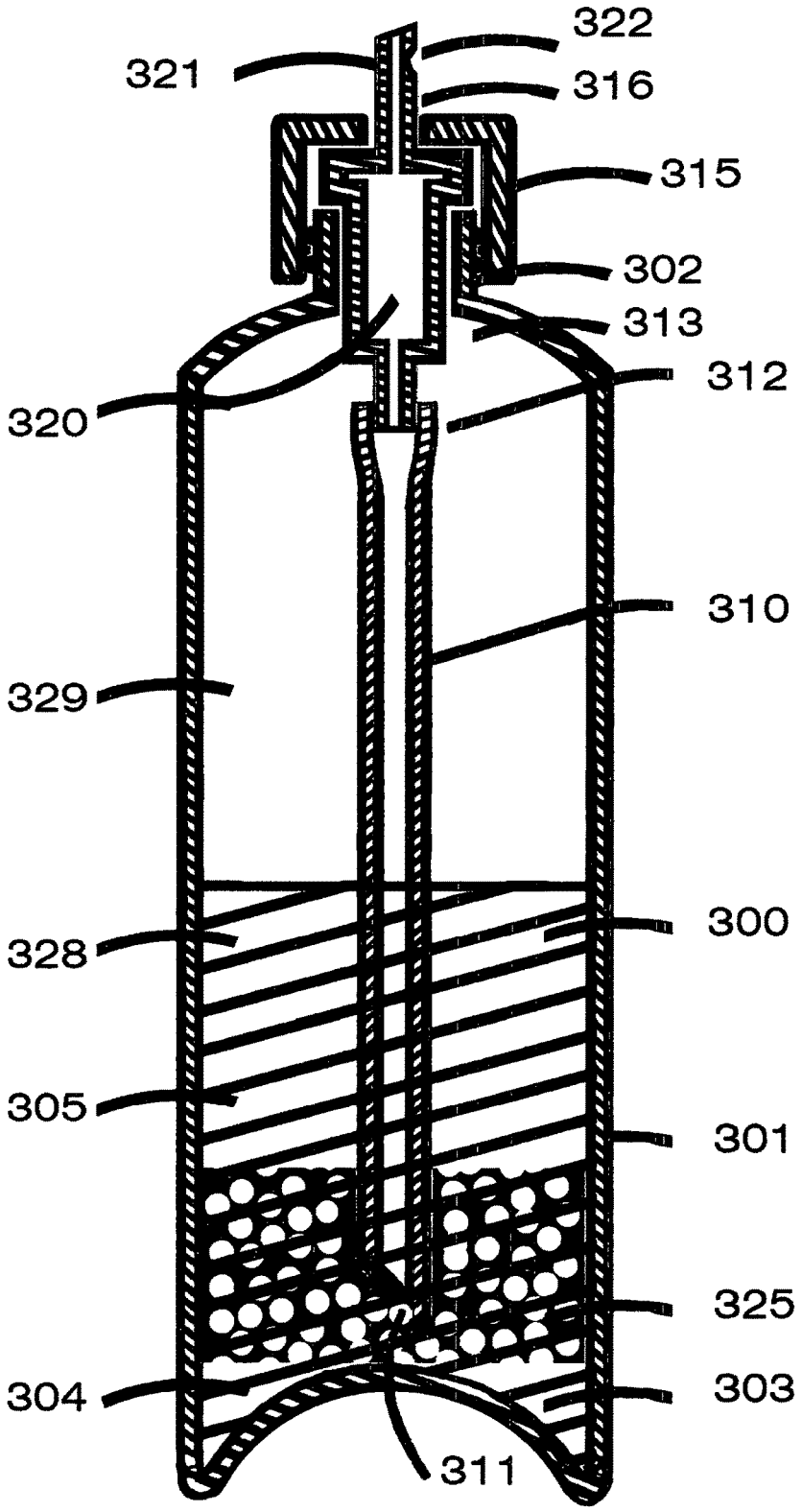
FIG. 3 is a cross-sectional view though a pump dispenser of the invention with a divider of the invention in the form of a foam plate inside.
Figure 5:
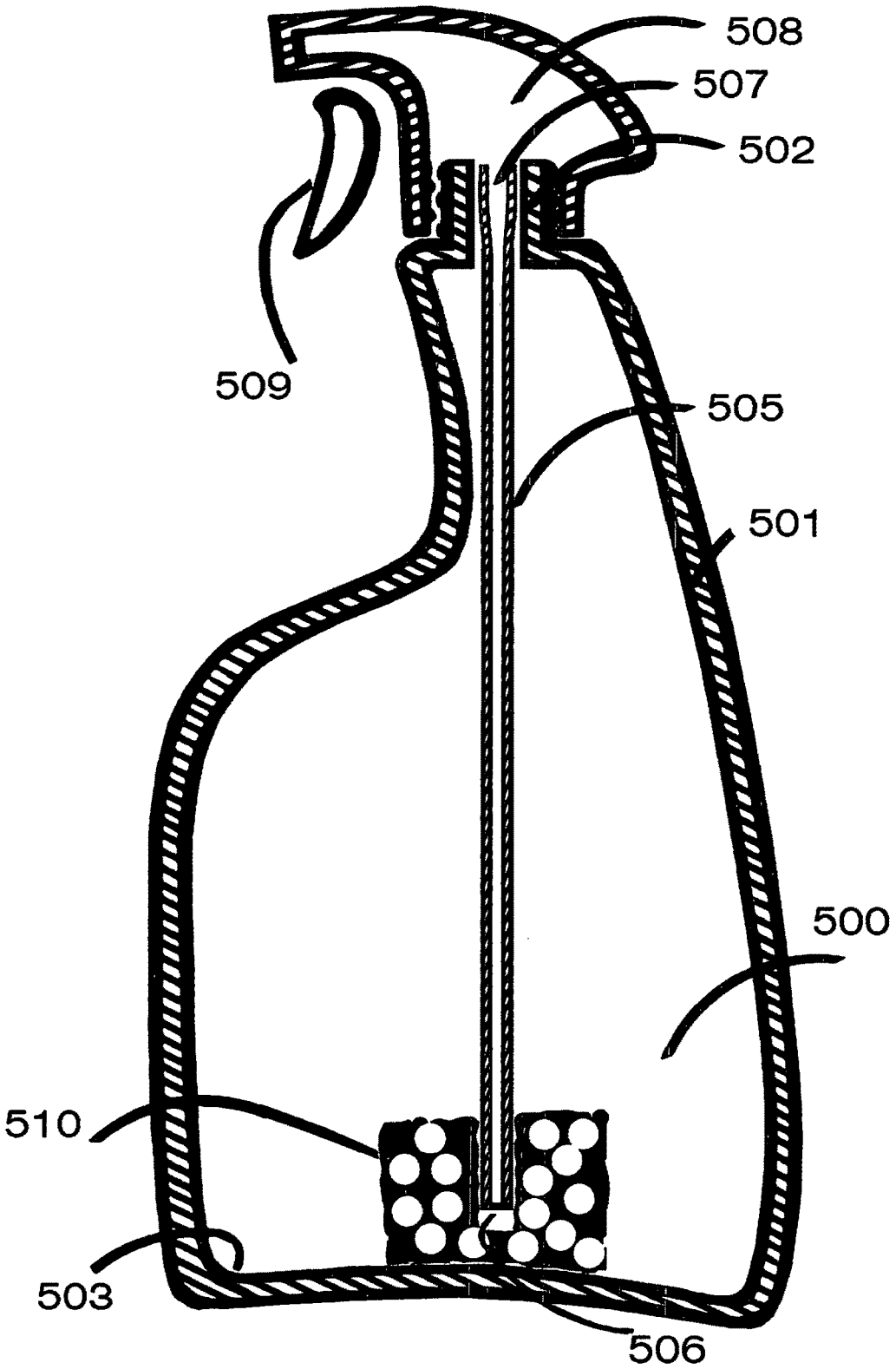
FIG. 5 is a cross-sectional view though a dispenser of the invention comprising a trigger with a foam rod divider inside.

FIG. 1 shows a pressurized canister with an outlet valve 115 but the same arrangement could equally be used with a non-pressurized container with a pump or trigger in place of the valve 115, similar to the pump or trigger shown in FIGS. 3 and 5. For these embodiments there would a leak hole in the pump or trigger or in the connection between them and the dispenser which would allow air to be pushed out or pulled in by the movement of the dividing plate 120 maintaining the air in the upper chamber 104 at atmospheric pressure. The fluid may be located in the downstream or lower chamber 103 before the dividing plate is inserted. The pump or trigger pumps fluid from chamber 103 through the diptube 110 and out of the pump or trigger outlet. The dividing plate is then drawn towards the base 101 of the container and air is drawn into the upper chamber 104.

In FIG. 2 there is a similar arrangement of an embodiment of a dispenser of the invention to that of FIG. 1 except there is no diptube or corresponding hole in the dividing plate 220. This time, to fill the canister the fluid is pumped through a valve stem 118 into the top chamber 104 and the divider plate 220 moves away from the top of the canister near to the valve 115 down towards the base 101 of the canister. The propellant or air is then added into the lower chamber 103 via a one way valve (not shown) that is fixed into the hole 201 on the base 101 of the canister and this permanently seals after filling. As the fluid is discharged by pressing on an actuator on the valve stem 118, the top chamber 104 reduces in size as the dividing plate moves upwards towards the outlet. The lower chamber 200 then increases in volume causing the gas pressure in the chamber to reduce unless a voc propellant is used.

FIG. 2 shows a pressurized canister of the invention with an outlet valve but the same arrangement could equally be used with a non-pressurized container with a pump or trigger in place of the valve 115, similar to the pump or trigger shown in FIGS. 3 and 5. For these embodiments there would a hole 201 in the base or lower walls of the dispenser but no valve inside it as the hole allows air to be pushed out or pulled in by the movement of the dividing plate 220 maintaining the air in the lower chamber 103 at atmospheric pressure. The fluid is put into the downstream or upper chamber 104 after the dividing plate is inserted and pushed next to the base of the container 101. The pump or trigger pumps fluid from chamber 104 through their inlet like 219 and out of the pump or trigger outlet. The dividing plate is then drawn towards the top or outlet of the dispenser and air is drawn into the lower chamber 103 via the hole 201.

This is true for all of the embodiments of FIGS. 1 to 6 which could all be used with pressurized containers including aerosol canisters, or with non-pressurized containers for pumps or triggers.

FIG. 3 shows an embodiment of a dispenser of the invention with a divider of the invention in the form of a dividing plate or disc 325 which is stationary and positioned substantially next to the base although it could be higher if required. The plate 325 is made from a porous material in the form of an open cell foamed or cellular material plate that absorbs liquid. A diptube 310 is present which has an angled downstream end 311 that is able to penetrate into the foamed plate 325. The dispenser has a single peak extending from the base 303 and this creates at least one annular chamber 304 between the base 303 and the plate 325. The container 300 is shown as holding fluid 328 in the lower half and air 329 in the top half. The foamed plate 325 is saturated with the fluid and the annular chamber 304 below the plate is also full of it, as is the diptube. The dispenser includes a pump 320 which is held onto the outlet of the neck 302 of the container with a threaded top 315 and has an outlet orifice 322. It could also have a trigger on top or the arrangement could be an aerosol canister with pressurized fluid. As the actuator 321 is depressed, fluid 328 exits via the orifice 322 and this is drawn from the container 300 through the foamed plate 325 and through the diptube 310. As fast as fluid is drawn from the foamed plate 325 it is replaced by fresh fluid that is drawn into the foam by the gas pressure and normal absorption. With a pressurized canister the fluid is pushed into the foamed plate 325 by the pressure of the propellant or air 329 and then through the diptube, and it is also absorbed into the foamed plate 325.

When the dispenser of FIG. 3 is tilted or inverted so the fluid tilts or drops to towards the outlet end 313. The fluid in the open cell foamed plate 325 stays inside the plate. The fluid in the small chamber 304 tends to stay inside the chamber when the dispenser 300 is tilted or inverted but some can escape into the plate or around it. When the dispenser is then turned upright it quickly returns to the original position. If the fluid is being discharged while the dispenser is being moved around, shaken, tilted or inverted fluid is drawn from the foamed plate 325 and replaced with other fluid in contact with it from either chamber so it continues discharging through all angles. Once the dispenser is then angled back up or is upright, fluid will quickly fill the smaller chamber and the foam plate 325 and the air will return to the large chamber 329. This is also true of an aerosol canister and the action is the same, save that the fluid replaces the propellant gas in the foamed plate and smaller chamber 304 when the dispenser is no longer inverted and the action is faster because of the propellant being pressurized. But these dispensers are used substantially upright in normal use and aren't tilted or turn upside down for more than a short period of time. The foamed plate is made with enough capacity to enable the fluid to be drawn from it rather than the air or gas and still have some left in the foamed plate 325 as the dispenser returns to a largely upright position enabling fluid to replace any air or gas in the foamed plate 325 and preventing the fluid or air being delivered to the diptube. So if the fluid is delivered slowly through the outlet 322 only a small volume of foam is required and if it is being delivered quickly a larger volume of foam is required. Most suitable foams are relatively inexpensive but still need to be minimized because of price pressure so the small chamber 304 can be a good storage chamber as it will supply the foamed plate 325 with more fluid when the dispenser is inverted. Even a small foamed plate 325 enables a user to deliver the fluid and still lose very little air or propellant. In other embodiments foamed plate 325 may have had part of its base shaped and extending into or filling the annular groove 303 and the end of the diptube 310 may be much closer to the base 303 of the dispenser and also angled into the annular chamber 304. The divider plate 325 could be any shaped required and could for example, have a large hole in the centre largely to reduce the cost with the diptube angled over into the foam divider plate, or ring as it would become.

Figure 4:
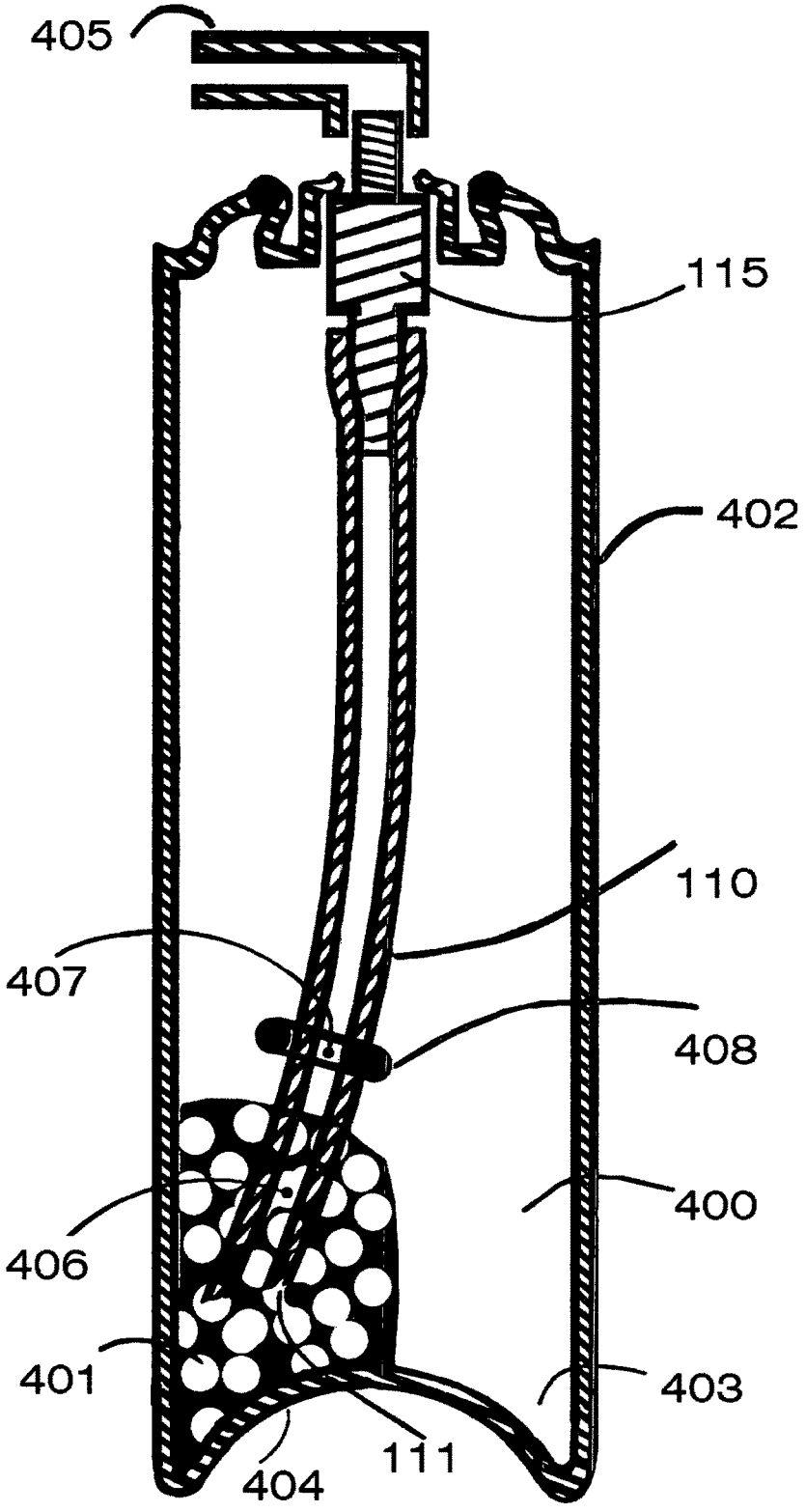
FIG. 4 is a cross-sectional view though a dispenser of the invention in the form of an aerosol canister with foam plug divider of the invention inside.

The embodiment shown in FIG. 4 comprises an aerosol canister 400 similar to that of FIG. 1 (like numerals represent like components) with a plug of cellular material or foam 401 instead of a divider plate or disc and the plug is on the end of the diptube 110 and inside part of the annular groove 403 does not create a smaller chamber below it. The plug could be any shape or size or material as required and it could be assembled in the dispenser or on the diptube and then put inside the dispenser. It could be placed as shown or in any other position near to the base 404 of the dispenser and it could be raised above the annular groove 403 creating a gap for fluid under it. Again, an aerosol canister has been shown but it could also be a pump or trigger with a non-pressurized container. The diptube 110 includes an inlet hole 111 as described above for other embodiments, but also a secondary hole 406 located partway up the diptube. Both holes 111 and 406 are covered by the plug part 401.

It is often an advantage to deliver additional air or gas to the dispensing liquids when the canister is emptying and the pressure reducing to improve the quality of the spray and ideally the lower the pressure and the more empty the canister, the greater the volume of air or gas added. One way to achieve this in conventional dispensers is to add more holes in the diptube or a hole further upstream from the end 111 of the diptube. But this normally causes other problems as when the canister isn't being used and the level of the liquor is below the hole, the gas or air gets into the diptube through the hole and displaces much of the liquor in the diptube which is driven out of the bottom of the diptube. This can represent a substantial loss of air for a compressed air canister and isn't desirable. The holes are also tiny and are easily blocked especially with the liquor flowing through them. If the holes are too far away from the end of the diptube then air or gas is lost sooner than required. The air or gas lost is proportional to the pressure in the canister yet you actually want more air or gas to be delivered through the hole as the canister empties. The air or gas can escape through the hole 406 when the canister is tilted, shaken or inverted if the liquor no longer covers the hole. These are all serious problems with compressed air aerosols in particular as it is essential to keep the canister pressure as high as possible. By adding the foam part 401 on the end of the diptube 110 as shown in the embodiment of FIG. 4 the tendency for the liquid to be pushed out of the diptube 110 is reduced so the air or gas is less likely to get inside when the canister 400 isn't being used. The secondary hole 406 also acts as an additional exit route for the liquid through the foam when the canister is inverted or tilted and this enables more fluid to be delivered as the forces at the end of the diptube 111 is often not sufficient to draw liquid from all of the foam. Another solution is to add a valve around the hole and this is achieved with a resiliently deformable band such as an O-ring 408 on a hole 407. The band 408 is sized so that at low pressures it naturally covers the hole 407 but doesn't seal it and instead allows a reduced flow through it but at high pressure the additional forces on the band 408 cause it to seal off the hole 407 allowing no fluid through. The higher the pressure the more it seals and the lower the pressure the more air or gas it allows through. This means more air or gas is delivered just when it is needed and the air or gas used over the canister lifetime can be fully controlled. This can be used with or without the foam plug part 401 on the end of the diptube 110. It can be positioned anywhere on the diptube 110 or even around the valve 115 but it is often best used lower down the diptube so that it only becomes exposed to the gas or air when the canister pressure has dropped to the level where extra gas or air is needed to be delivered through the hole. Many different chemicals are used in aerosols and some of these react with the band making it larger or smaller and this in turn makes it open at different pressures and by different amounts. It doesn't matter if it opens sooner than ideal if the dispensing liquid is covering the hole as no air or gas can escape. The lower the band the less the problem of loss of gas or air to the diptube when the canister isn't being used as it only potentially becomes a problem when the liquid level is below the hole and that means that relatively little is lost over the lifetime of the canister. For compressed air aerosols, additional air is generally only required for the last 20-25% of the canister life. The band could also be put inside the foam if required. A one way valve could be added to the downstream end 111 of the diptube as well as the band to prevent any loss of air or gas when the canister is stationary as it would fully prevent the escape of any of the liquid in the diptube.

It has been found that an O-ring is a good shape for the band because it seals the hole more efficiently than a band and it deforms more around the hole as the canister pressures increases. It also gives a more consistent flow increase with the reducing pressure in the canister.

In FIG. 5 there is provided an embodiment of a dispenser of the invention comprising a trigger 508 and container 500. A porous foam or cellular material plug 510 is on the end 506 of a diptube 505 and be close to a base 503. Trigger bottles tend to be large, especially in the base, therefore the foamed plug 510 is mounted to the diptube 505 before assembly. In other embodiments such as spray pumps in the form of perfume pumps, the dispensers are very small and only a small foam plug may be needed and can be positioned onto the diptubes. Some aerosol cans are very large and again the same applies. For most applications with aerosol canisters, pumps and triggers where the fluid and propellant don't have to be permanently separated, this is an efficient configuration although the shape of the plug may be different to that described above. It is relatively simple and cheap and easy to install that the price is relatively low. The diptube may also be flexible allowing the foamed part to move around under the weight of the dispensing liquid contained in it so that it will tend to stay immersed in the liquid.

Figure 6:
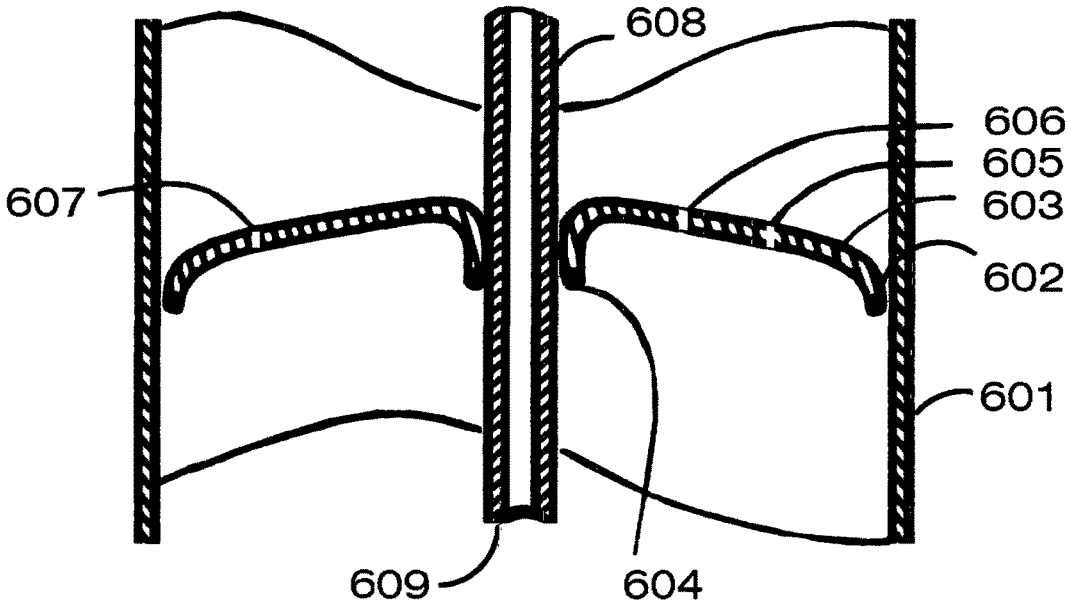
FIG. 6 is a cross-sectional view though a dispenser of the invention with a fixed divider of the invention inside.

FIG. 6 illustrates an embodiment of a dispenser of the invention comprising part of a container 601 which may be for a trigger, pump or aerosol, and which includes a diptube 606, and a fixed divider plate 607 with small holes 605, 606 and 607 through the top surface and partial annular seals 602 and 604. Similar to the small chamber 303 in the embodiment of FIG. 3, there is a chamber between a fixed plate 607 and the base of the container 601. The proximity of the plate 607 to the container base determines the size of the chamber but it would normally be close to the base as in FIG. 3. The air or gas as well as the fluid is free to move from one chamber to the other either through the small holes in the plate 607 or through the partial seals 602 and 604 which are set to allow some movement but to slow it down so little gas or air is lost during use.

In general for aerosol canisters and especially those producing an atomised spray particularly with compressed air or gas propellants, the pressure in the canister when it is nearly empty is often very low, resulting in a poor spray. It is known that adding some of this gas or air into the fluid at this time greatly improves the spray quality. Careful positioning of the diptube in combination with the correct foam size can be used to enhance the spray quality then because the fluid from the foam will be mixed with the air or gas in the foam and delivered together. Also, shaping the end of the diptube and its diameter will also alter the amount of propellant or gas drawn into the fluid. As the fluid level in the canister reduces so it reduces in the foam and the gas or air will replace it so when the diptube is exposed to the gas or air, it has a free run from the chamber above and it will be readily drawn through the diptube along with the fluid. By varying the foam cell size and the height of the angle of the end of the diptube air or gas that is added to the fluid can be controlled, enhancing the spray quality. As already described a simple and effective improvement is to add a hole or holes in the side of the diptube away from the upstream end of the diptube but still covered by the foamed part as shown in the FIG. 4 embodiment. Holes in diptubes would normally be very small but still allow a lot of gas or air to escape which is normally too much and by covering the hole with the foam this is considerably reduced giving the enhanced performance with an acceptable gas or air loss.

The type of porous or cellular material is important both interiors of material and what the average cell size is as well as the free space available and the actual size of the part and the density. A very fine cell structure with small chambers is little use with big flows of liquor or even with viscous liquids. Equally a coarse cell structure is not practical for tiny flows such as for perfume pumps. The foam also needs to be able to retain the fluid when inverted or out of the fluid or when the container is shaken and many coarse foams don't retain much fluid in those circumstances whereas fine foam may. Some foams absorb up to 15 times their size whereas others only absorb small volumes. Since it can be used for a wide variety of fluids, delivery systems, flows and discharge volumes, many types of foam will be used from fine to coarse and with a wide range of properties and materials. Also, many shapes and sizes of the divider part itself will be used. The divider part is essentially a reservoir of the fluid so if there is a small discharge then the fluid reservoir does not need to hold much fluid whereas if there is a large discharge it does. Also, if the dispenser is used upright for most of the time then the fluid will keep flowing through the divider and consequently a smaller divider is required whereas if the divider is often out of the fluid because of the dispenser being tilted and turned upside down a greater reservoir will be needed and the foamed part will need to be larger. Open cell foamed dividers may have an impermeable surface and one or more of the sides of the foamed divider could retain this so that fluid and air or propellant could only be drawn though the other sides, or part of the surface could be opened up with fine holes. Some closed cell foams may function like open cell foams if the surface has holes.

In some embodiments the porous or cellular material comprises pores having an average pore size of at least 50 microns, at least 100 microns or at least 200 microns, and may have a pore size of no more than 1000 microns, no more than 750 microns or no more than 500 microns.

In some embodiments the fluid reservoir, such as the porous material, may comprise a material having at least 10 ppi (pores per inch), at least 20 ppi and at least 30 ppi, and may have no more than 100 ppi, 80 ppi, 70 ppi or 60 ppi.

In some embodiments the fluid reservoir may hold at least 0.5 ml of fluid, or at least 1 ml or at least 2 ml.

In some embodiments the fluid reservoir holds at least 0.5 ml of liquid and has at least 10 ppi or at least 20 ppi.

One of the problems associated with dispensers with diptubes may be retaining the divider on the diptube during transportation and assembly so the divider may need to be permanently fastened to the diptube. This can be done in a variety of ways including heat welding, ultrasonic welding, fixing with a clip or wire, or fixing part of the skin of a foam divider instead of the foam itself. For porous foamed dividers preferred method is to push a pin through the foam divider and the diptube and bending the pin so as to trap the foam onto the diptube. This is usually done near to the input of the diptube. A staple or fastener could be used instead of the pin and one or both of the legs could be shaped to leak around them and this could also be arranged for the pin. Simply shaping or roughening the surface of the legs would cause such a leak and this could be used instead of making holes in the diptube under the foam. The staple or pin could be positioned so as to allow gas or air to escape into the diptube when the dispenser has been used to a set level such as 80 or 90% to improve the spray quality by fixing it to the appropriate position on the diptube.

Some absorbents like some foams can be made inside the dispenser and the diptube pushed into it during assembly and in some cases this may be the better option.

For foam dividers the foam should generally let any air or gas trapped in it to escape quickly and should and able to tolerate a range of different chemistry.

The volume of the foam may be important as it has to hold enough dispensing liquid to enable the dispenser to keep discharging liquid when the device is tilted or inverted or shaken. If the foam is partially immersed in the liquor then it will tend to draw on that liquor and that will go to the inlet of the diptube in preference to the gas or air but as the liquor in the foam is used up so air or gas will be lost along with the new liquor entering the foam. If the foam does not touch the liquor then as the liquor in the foam is expelled so the gas or air is lost through the foam. Aerosols deliver liquor at varying rates between 0.3-4 mls per second with 1 ml per second being common. So if there is only a small volume of foam and therefore a small volume of liquid that the foam can hold then the liquid can quickly be used up and the air or gas will rapidly escape and it takes a very short amount of time before it become critical. The greater the volume of foam the better, and generally 1 ml foam would be the minimum needed but it may be between 3-20 mls. In terms of the liquid the foam can hold, this may be at least 0.5 mls and preferably 1-3 mls and even more preferably 3-20 mls.

Foam is measured in pores per inch or "ppi" and the smaller the number the coarser the foam and the higher the number the finer the foam. The more the pores per inch and the finer they are the denser the foam. With higher ppi foams such as 90 ppi and over, the pore size is very small and that makes them suitable for filters but it also reduces the volume of liquid that they can hold. Conversely, coarser foams below 20 ppi have very low density foam with large sell sizes that could potentially hold far more liquid and it flows easily through it but the foam may not be able to retain the liquid if it isn't immersed in it. A pore size that enables the foam to retain the liquid if the dispenser is inverted or shaken but that also holds as much liquor as possible should be used. This also depends on the viscosity of the liquid as higher viscosities can be retained in larger pore sizes than lower viscosities and the greater the viscosity the greater the cell size needs to be in order to allow the liquid through. The porous material preferably comprises more than 10 ppi and most preferably greater than 20 ppi but the average pore size is preferably less than 120 microns and most preferably less than 90 microns.

Foam materials have been exemplified but any absorbent, cellular or porous material that allows fluid to flow through freely could be used instead, and the pore sizes, capacities and ppi described above apply thereto.

With an upright pressurized dispenser the air or gas tends to settle on top of the liquid present and consequently when the porous material is immersed the pressure of the air or gas causes the liquid to drive any air or gas out of the material and into the dispenser replacing the gas with liquid and ensuring that the foam is always full of liquid. This is also true if the dispenser is tilted anywhere above the horizontal provided the dispenser isn't substantially empty. Since pressurized canisters are generally always left standing upright after use this means that the foam will be recharged with liquid after use, but as this is a very quick action it tends to be recharged during use as well. If the level of the liquid goes below the top of the porous material then the gas will go to the same position in the porous material as the top of the liquid, the porous material may also absorb some liquid moving the air higher. The gas won't tend to go into the diptube because it is full of liquid and the gas takes the easiest route. In addition to the force of the gas or air pushing the liquid into the foam and the gas or air out, there is also a natural tendency for a porous material to absorb the liquid again replacing at least some of the gas or air. The larger the cell size the easier it is for the liquid to replace the gas or air.

The invention described can be used to produce a spray, foam or bolus of liquid from pressurized dispenser, or pump or trigger dispensers.

Whereas the invention has been described in relation to what is presently considered to be the most practical and preferred embodiments, it is to be understood that the invention is not limited to the disclosed arrangements but rather is intended to cover various modifications and equivalent constructions included within the spirit and scope of the invention.

The invention claimed is:

1. A pressurized dispenser, comprising:

a base around which surrounds a peripheral wall having an open end sealed by a dispensing element comprising a dip-tube, a fluid reservoir in contact with the dip-tube for reducing compressed gas lost from the pressurized dispenser, a compressed gas and a dispensing liquid, and a peak extending from the base into an interior defined by the peripheral wall to form at least one annular chamber around the peak, wherein a majority of said fluid reservoir being located outside of the dip-tube and the fluid reservoir comprises a porous material, arranged in use to hold a volume of the dispensing liquid, the porous material being configured so that in use at least a portion of any compressed gas in the reservoir can be displaced by the liquid, ejecting said portion of the compressed gas into the dispenser, wherein the dispensing element is configured to dispense the dispensing liquid continuously for at least 0.5 seconds, upon actuation of the dispensing element, wherein the porous material is one of inside at least a portion of the annular chamber and above the annular chamber, and wherein the fluid reservoir has substantially the same refractive index as the dispensing fluid.

2. The pressurized dispenser as claimed in claim 1, wherein the porous material comprises a foam or cellular material.

3. The pressurized dispenser as claimed in claim 1, wherein the reservoir comprises a polymeric material selected from polyurethane, polystyrene, polypropylene, polyethylene, polyvinylchloride or a combination thereof.

4. The pressurized dispenser as claimed in claim 1, wherein the reservoir holds at least 0.5 ml, at least 1 ml or at least 2 ml or at least 5 ml of dispensing liquid.

5. The pressurized dispenser as claimed in claim 1, wherein at least one of:

the porous material comprises at least 10 ppi (pores per inch), at least 20 ppi or at least 30 ppi; and the porous material comprises no more than 80 ppi, no more than 75 ppi or no more than 70 ppi.

6. The pressurized dispenser as claimed in claim 1, wherein the porous material comprises no more than 80 ppi, no more than 75 ppi or no more than 70 ppi.

7. The pressurized dispenser as claimed in claim 1, wherein the reservoir forms a barrier within the dispenser through which the dip-tube extends, the dip-tube having a fluid inlet end located at or near the base of the dispenser.

8. The pressurized dispenser as claimed in claim 7, wherein the reservoir is located at or near the fluid inlet end of the dip-tube.

9. The pressurized dispenser as claimed in claim 8, wherein the reservoir covers the fluid inlet end of the dip-tube.

10. The pressurized dispenser as claimed in claim 9, wherein the reservoir forms a plug at the end of the dip-tube comprising the fluid inlet.

11. The pressurized dispenser as claimed in claim 1, wherein the dip-tube comprises a fluid inlet at an end thereof, and a second fluid inlet located along a length of the dip-tube, and the reservoir covers both fluid inlets.

12. The pressurized dispenser as claimed in claim 1, wherein the porous material comprises pores having an average pore size of at least 50 microns, at least 100 microns or at least 200 microns.

13. The pressurized dispenser as claimed in claim 1, wherein the porous material comprises pores having an average pore size of no more than 1000 microns, no more than 750 microns or no more than 500 microns.

14. The pressurized dispenser as claimed in claim 1, wherein the dip-tube comprises a fluid inlet at an end thereof, a second fluid inlet located along a length of the dip-tube, and a valve around the second fluid inlet.

15. The pressurized dispenser as claimed in claim 14, wherein the valve is a resiliently deformable band.

16. The pressurized dispenser as claimed in claim 15, wherein the resiliently deformable band is an O-ring.

17. The pressurized dispenser as claimed in claim 14, wherein the valve is adapted so that at low pressures it naturally covers the second fluid inlet but doesn't seal it and instead allows a reduced flow through it, and at high pressure additional forces on the valve cause it to seal off the second fluid inlet allowing no fluid through.

18. The pressurized dispenser as claimed in claim 1, wherein the porous material is in the form of a disc stationary within the interior.

19. A method of forming a pressurized dispenser, the method comprising:

providing a dispenser comprising a base around which surrounds a peripheral wall having an open end, and a peak extending from the base into an interior defined by the peripheral wall to form an annular channel around the peak; and in any order or together, inserting a porous fluid reservoir into the dispenser such that a porous fluid reservoir material of the porous fluid reservoir is one of inside at least a portion of the annular channel and above the annular channel;

inserting a dip-tube having a fluid inlet end into the open end of the dispenser; and adding a dispensing liquid and compressed gas to the dispenser, wherein the porous fluid reservoir has substantially the same refractive index as the dispensing liquid.

20. The method of claim 19, including partially filling the dispenser with the dispensing liquid such that at least some of the liquid enters the porous fluid reservoir material, partially filling the dispenser with a compressed gas, and actuating a dispensing element configured to seal the open end to dispense at least a portion of the dispensing liquid.

21. A pressurized dispenser, comprising:

a base around which surrounds a peripheral wall having an open end sealed by a dispensing element comprising a dip-tube, a fluid reservoir in contact with the dip-tube for reducing the compressed gas lost from the pressurized dispenser, a compressed gas and a dispensing liquid, wherein a majority of said fluid reservoir being located outside of the dip-tube and the fluid reservoir comprises a porous material, arranged in use to hold a volume of the dispensing liquid, the porous material being configured so that in use at least a portion of any compressed gas in the reservoir can be displaced by the liquid, ejecting said portion of the compressed gas into the dispenser; wherein the dispensing element is configured to dispense the dispensing liquid continuously for at least 0.5 seconds, upon actuation of the dispensing element; and wherein the fluid reservoir has substantially the same refractive index as the dispensing fluid.

* * * * *